United States Patent [19]

Dethlefsen

[11] 4,204,101

[45] May 20, 1980

[54] HYBRID CIRCUIT BREAKER WITH VARISTOR IN PARALLEL WITH VACUUM INTERRUPTER

[75] Inventor: Rolf Dethlefsen, Greensburg, Pa.

[73] Assignee: Gould Inc., Rolling Meadows, Ill.

[21] Appl. No.: 808,811

[22] Filed: Jun. 22, 1977

[51] Int. Cl.[2] ..... H01N 33/16

[52] U.S. Cl. ..... 200/144 AP; 200/145; 200/144 B; 200/148 R

[58] Field of Search ..... 200/144 AP, 144 B, 148 A, 200/148 R, 145

[56] References Cited

U.S. PATENT DOCUMENTS

| | | | |
|---|---|---|---|
| 2,279,040 | 4/1942 | Grosse | 200/148 A |
| 3,147,356 | 9/1964 | Luehring | 200/144 B |
| 3,174,019 | 3/1965 | Jansson | 200/144 B |
| 3,244,842 | 4/1966 | Kameyama et al. | 200/144 B |
| 3,982,088 | 9/1976 | Porter | 200/144 B |
| 4,087,664 | 5/1978 | Weston | 200/144 B |

FOREIGN PATENT DOCUMENTS

| | | | |
|---|---|---|---|
| 1290220 | 4/1967 | Fed. Rep. of Germany | 200/144 AP |

*Primary Examiner*—Robert S. Macon

*Attorney, Agent, or Firm*—Ostrolenk, Faber, Gerb & Soffen

[57] ABSTRACT

A hybrid circuit breaker consisting of a vacuum interrupter connected in series with an $SF_6$ interrupter has a zinc oxide varistor connected in parallel with the vacuum interrupter. The capacitance to ground of the $SF_6$ interrupter is higher than the capacitance to ground of the vacuum interrupter.

11 Claims, 3 Drawing Figures

HYBRID CIRCUIT BREAKER WITH VARISTOR IN PARALLEL WITH VACUUM INTERRUPTER

RELATED APPLICATIONS

This application is related to copending application Ser. No. 609,161, filed Aug. 29, 1975, now U.S. Pat. No. 4,087,664, in the name of Donald E. Weston and entitled HYBRID POWER CIRCUIT BREAKER

BACKGROUND OF THE INVENTION

This invention relates to high voltage circuit interrupters, and more specifically relates to a novel hybrid circuit interrupter consisting of a vacuum interrupter connected in series with an $SF_6$ type interrupter with a varistor being connected in parallel with the vacuum interrupter to decrease the need for grading capacitors and to prevent the generation of high frequency discharges from the vacuum interrupter.

Interrupters consisting of the series connection of simultaneously opened diverse devices, particularly an $SF_6$ interrupter and a vacuum interrupter, are well known, and are shown, for example, in the above-noted copending application Ser. No. 609,161, now U.S. Pat. No. 4,087,664, and in U.S. Pat. No. 3,982,088.

These devices combine the high dielectric strength of compressed $SF_6$ (or interrupters using a similar electronegative gas or mixtures of electronegative gases), with the rapid dielectric recovery characteristics of a vacuum interrupter following a current zero. Thus, in the first few tens of microseconds following a current zero, the system recovery voltage is sustained by the vacuum interrupter. This period of time allows the proper deionization of the $SF_6$ gas in the $SF_6$ interrupter, so that the $SF_6$ interrupter becomes capable of sustaining high voltage.

A problem has existed in the past of properly distributing the recovery voltage between the vacuum and $SF_6$ interrupters. This can be obtained with parallel grading capacitors, but such capacitors for a 60 hertz system become excessively large.

Another problem with such systems is the tendency of the vacuum interrupter to display pre-discharges at high voltage levels before a full discharge occurs. These pre-discharges lead to high frequency currents in the system being protected, which can generate dangerous high frequency overvoltages due to the circuit inductance and capacitance. U.S. Pat. No. 3,982,088 proposes the mechanical reclosing of the vacuum interrupter after 2 to 20 cycles. This, however, does not elimate high frequency oscillation during the most critical time, shortly after interruption.

BRIEF DESCRIPTION OF THE INVENTION

In accordance with the present invention, a varistor device is placed in parallel with the vacuum interrupter and is designed to become conductive at a voltage below that where the vacuum interrupter will exhibit high frequency oscillation. In a preferred embodiment of the invention, the varistor is a zinc oxide varistor of the type made by the Matsushita Electric Industrial Co. under the trade name ZNR varistor. This device will become conductive within nanoseconds when the voltage across its terminals exceeds about 100 kV without regard to polarity, which is the voltage at which certain vacuum interrupters will begin to exhibit high frequency discharge. Clearly, other voltages could be selected as the varistor breakdown voltage depending on design of the vacuum interrupter and of the varistor.

To insure that the vacuum gap will be stressed with the initial portion of the rising circuit recovery voltage, the vacuum interrupter and the series-connected $SF_6$ interrupter should be arranged so that the stray capacitance to ground of the $SF_6$ unit is higher than that of the stray capacitance to ground of the vacuum unit. This can be accomplished by mounting the vacuum unit on top of the $SF_6$ unit, or otherwise insuring that the vacuum unit is farther from the grounded support of the hybrid assembly. If desired, a small discrete capacitor can be connected across the $SF_6$ interrupter.

The use of the novel varistor in parallel with the vacuum interrupter then decreases or eliminates the need for expensive grading capacitors and further prevents the generation of high frequency discharges in the vacuum unit.

DETAILED DESCRIPTION OF THE DRAWINGS

Figure 1:
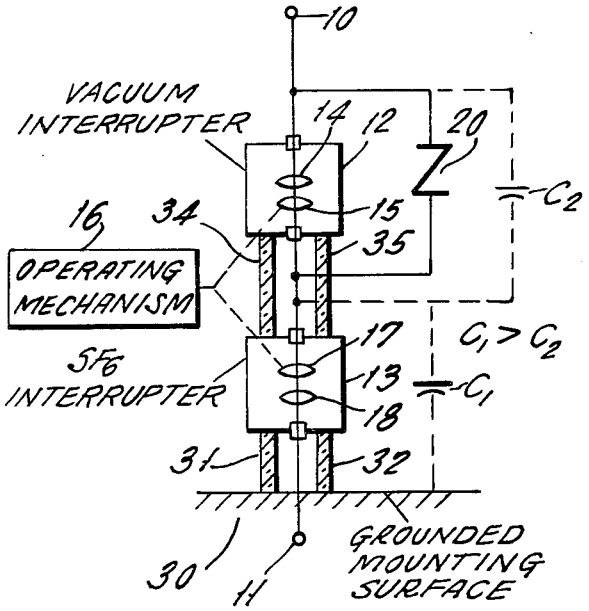
FIG. 1 is a schematic circuit diagram of the present invention.

Referring first to FIG. 1, there is shown a single phase of a hybrid interrupter which is to be connected between the terminals 10 and 11 of a high voltage, high power electric transmission line system. By way of example, the system of FIG. 1 can be a 145,000 volt or 230,000 volt transmission system. A hybrid interrupter system is provided in the system which comprises a conventional vacuum interrupter 12 which is connected in series with an $SF_6$ interrupter 13 in the manner shown in copending application Ser. No. 609,161, now U.S. Pat. No. 4,087,664. A multiplicity of hybrid breaker modules, each designed for 145 kV or 230 kV, may be series-connected for higher voltage ratings.

Vacuum interrupter 12 is of any desired commercially available type and may contain a stationary contact 14 and a cooperable movable contact 15 contained within an evacuated container. Interrupter 12 may be rated at 15 kV or above. An operating mechanism 16 is provided to operate contacts 14 and 15 between their engaged and disengaged positions.

The $SF_6$ interrupter 13 contains a pair of cooperable contacts 17 and 18 which are operated in an atmosphere of an electronegative gas such as $SF_6$ or a mixture of $SF_6$ with other suitable gases. The interrupter 13 may be a conventional puffer type interrupter, a conventional two-pressure gas blast interrupter, or a bottle-type $SF_6$ interrupter of the type shown in copending application Ser. No. 609,231, filed Sept. 2, 1975, now U.S. Pat. No. 4,052,577, in the name of Gerald A. Votta, or copending application Ser. No. 609,559, filed Sept. 2, 1975, now U.S. Pat. No. 4,052,576, in the name of Robert K. Smith. Operating mechanism 16 is also connected to contacts 17–18 and is operable to open these contacts simultaneously with the opening of contacts 14 and 15. The $SF_6$ interrupter, by itself, may have an interrupting rating of 72 kilovolts or above.

Any suitable control (not shown) can be provided for mechanism 16 such that it can be operated manually or in response to a fault or some other condition in the line including terminals 10 and 11. If desired, the vacuum interrupter 12 may be reclosed after interruption is obtained and just after the $SF_6$ interrupter 13 is capable of withstanding the full line voltage.

Figure 2:
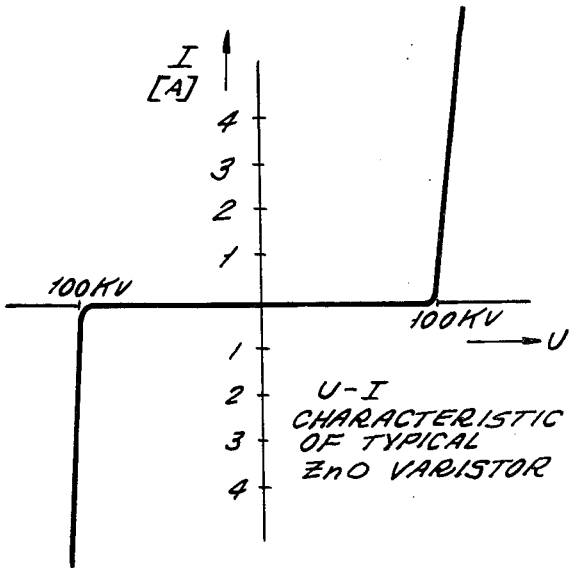
FIG. 2 shows the characteristics of the varistor used in the circuit of FIG. 1.

In accordance with the present invention, a varistor 20 is connected in parallel with vacuum interrupter 12. Varistor 20 is preferably a zinc oxide varistor and may be of the type known as a ZNR varistor, made by Matsushita Electric Industrical Co. This device is essentially an insulator up to some defined voltage level where it conducts without regard to polarity. The device will begin to conduct in a few nanoseconds after its conduction level is reached. In the ZNR varistor, the activation voltage is about 100 kV, and its voltage-current characteristics are shown in FIG. 2. As will be shown, the varistor 20 will relieve vacuum interrupter 12 of excessive voltage levels which would cause high frequency discharge.

As a further feature of the invention, the vacuum interrupter 12 is mounted or arranged so that it will have a lower capacitance to ground than the $SF_6$ interrupter 13. FIG. 1 schematically illustrates a grounded mounting surface 30 for mounting the hybrid assemblage, and interrupter 13 is schematically shown as mounted on insulations supports 31 and 32. The vacuum interrupter 12 is then mounted on top of interrupter 13 by the insulation posts 34 and 35. Thus, interrupter 12 is farther removed from ground 30 and, consequently, the strap capacitance $C_2$ to ground of interrupter 12 will be less than the stray capacitance $C_1$ to ground. Consequently, it is insured that a large percentage of the recovery voltage will be initially applied across the vacuum interrupter 12. Note that a small physical capacitor can also be connected across interrupter 13, if desired.

Figure 3:
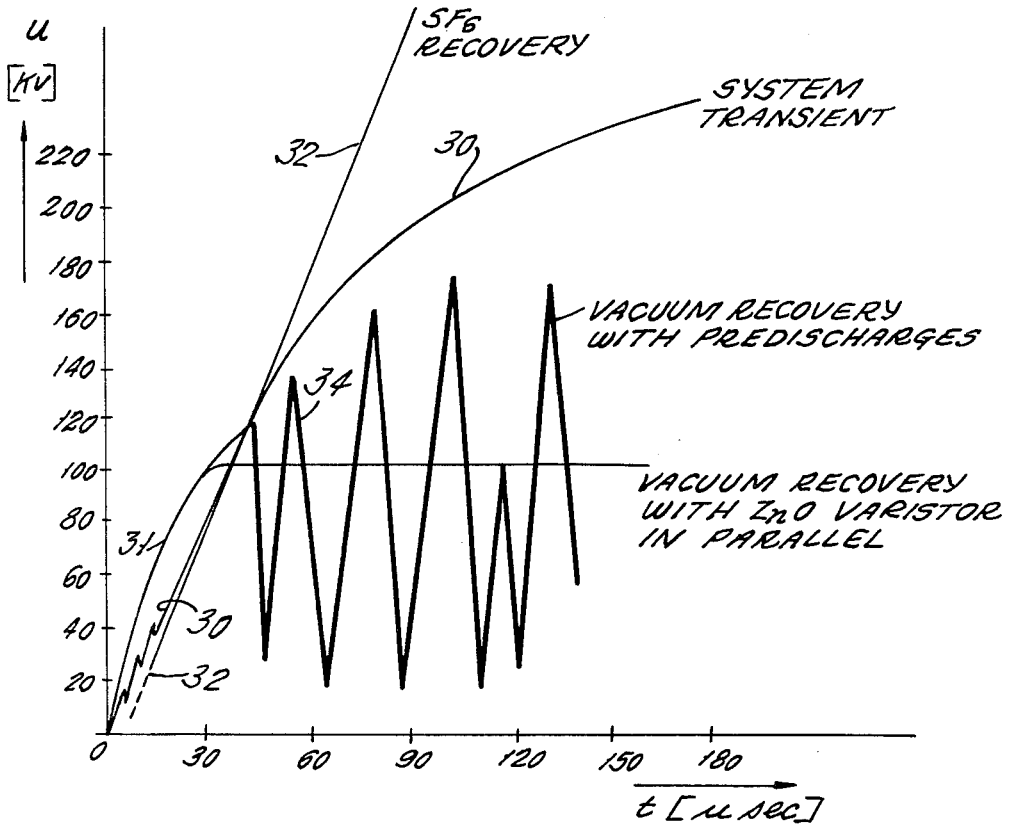
FIG. 3 shows the characteristics of the hybrid interrupter of FIG. 1 with and without the varistor structure in parallel with the vacuum interrupter for a typical 145 kV short line fault application.

The operation of the circuit of FIG. 1 can be best understood from FIG. 3. Referring to FIG. 3, a system transient voltage after current zero is shown as curve 30, which is the voltage across terminals 10 and 11 in FIG. 1 after contacts 14–15 and 17–18 have opened essentially simultaneously. The vacuum interrupter has the characteristic of very fast recovery, and, for about the first 40 microseconds, the vacuum interrupter contacts withstand the system transient voltage, as shown by curve 31. Note that the $SF_6$ interrupter recovery characteristics, for about the first 40 microseconds, is insufficient to withstand the system transient voltage, as shown by the $SF_6$ recovery characteristic 32. However, once the $SF_6$ interrupter has recovered, after about 40 microseconds, it becomes capable, by itself, to withstand the system transient.

In the past, once the system transient across the vacuum interrupter exceeded about 100 kV, the vacuum interrupter began to exhibit the high frequency discharge characteristic 34 shown in FIG. 3. This was detrimental to the transmission line circuit, and continued until the vacuum interrupter was reclosed or the line was otherwise opened.

In accordance with the present invention, the varistor 20 becomes conductive at a time (corresponding to the 100 kV point in the present example) just after the $SF_6$ interrupter is capable of withstanding the system voltage and before the vacuum interrupter begins to enter into a high frequency discharge mode. Consequently, it is possible to eliminate large and expensive parallel capacitors to insure appropriate voltage division between the interrupters, and to prevent high frequency discharge of the vacuum interrupter.

It should be noted that the present invention is not restricted to a particular geometry of construction. In more conceptual terms, the basic concept of a gas interrupter in series with a vacuum interrupter makes use of the thermal conduction of gas as the means of directing initial voltage to the vacuum. During the time the gas is conductive, there is little voltage available to allow capacitance across the $SF_6$ gap to exercise much influence. Nearly the total voltage drop will initially be seen by the vacuum interrupter. After the $SF_6$ recovers thermally, proper division of the voltage is required. The zinc oxide is effective during that portion of the recovery and during steady state withstand.

Although a preferred embodiment of this invention has been described, many variations and modifications will now be apparent to those skilled in the art, and it is therefore preferred that the instant invention be limited not by the specific disclosure herein but only by the appended claims.

I claim:

1. A hybrid circuit interrupter comprising a vacuum circuit interrupter, an electronegative gas circuit interrupter connected in series with said vacuum interrupter, an operating mechanism for simultaneously opening said vacuum circuit interrupter and electronegative gas circuit interrupter, and a varistor connected in parallel with said vacuum interrupter.

2. The hybrid interrupter of claim 1 wherein said electronegative gas circuit interrupter is an $SF_6$ interrupter.

3. The hybrid interrupter of claim 1 wherein said varistor is a zinc oxide varistor.

4. The hybrid interrupter of claim 1 wherein said vacuum interrupter produces high frequency oscillations when the voltage thereacross exceeds a given value; said varistor becoming conductive at a voltage lower than said given value.

5. The hybrid interrupter of claim 4 wherein said electronegative gas interrupter has a recovery voltage characteristic which enables it to withstand the voltage across said series-connected interrupters by the time said given value of voltage is reached.

6. The hybrid interrupter of claim 5 wherein said electronegative gas circuit interrupter is an $SF_6$ interrupter.

7. The hybrid interrupter of claim 6 wherein said varistor is a zinc oxide varistor.

8. The hybrid interrupter of claim 1 wherein the capacitance of said vacuum interrupter to a ground is less than the capacitance of said electronegative gas interrupter to ground.

9. The hybrid interrupter of claim 8 wherein said vacuum interrupter is mounted on said electronegative gas interrupter and is farther removed from a grounded support than said electronegative gas interrupter.

10. The hybrid interrupter of claim 5 wherein the capacitance of said vacuum interrupter to a ground is less than the capacitance of said electronegative gas interrupter to ground.

11. The hybrid interrupter of claim 10 wherein said vacuum interrupter is mounted on said electronegative gas interrupter and is farther removed from a grounded support than said electronegative gas interrupter.

* * * * *